United States Patent [19]

Currie et al.

[11] 4,400,697

[45] Aug. 23, 1983

[54] METHOD OF LINE BUFFER LOADING FOR A SYMBOL GENERATOR

[75] Inventors: Glenn E. Currie, Mastic; Erika Fremed, Wantagh, both of N.Y.

[73] Assignee: Chyron Corporation, Melville, N.Y.

[21] Appl. No.: 275,277

[22] Filed: Jun. 19, 1981

[51] Int. Cl.[3] ..... G09G 9/30

[52] U.S. Cl. ..... 340/711; 340/735; 340/748; 340/790; 400/111; 354/6

[58] Field of Search ..... 340/744, 748, 750, 735, 340/790, 723, 724, 726, 789, 792, 711; 354/6, 7, 8, 9, 5; 400/111

[56] References Cited

U.S. PATENT DOCUMENTS

| | | | |
|---|---|---|---|
| 3,513,968 | 5/1970 | Hanson | 400/111 |
| 3,569,951 | 3/1971 | Lavenir | 340/748 |
| 3,665,450 | 5/1972 | Leban | 340/748 |
| 3,946,407 | 3/1976 | Ishii et al. | 340/751 |
| 4,298,773 | 11/1981 | Diab | 400/111 |

FOREIGN PATENT DOCUMENTS

| | | | |
|---|---|---|---|
| 54-124935 | 9/1979 | Japan | 340/790 |
| 54-124937 | 9/1979 | Japan | 340/790 |

*Primary Examiner*—Marhsall M. Curtis
*Attorney, Agent, or Firm*—Hane, Roberts, Spiecens & Cohen

[57] ABSTRACT

In a symbol-display system which includes a keyboard for entering codes related to the symbols to be displayed and a memory for storing the codes associated with a line of symbols to be displayed, the symbols being from a font which includes at least one character represented by a set of symbols wherein the actual symbol to be used of the set is determined by the presence or absence on the displayed line of a space symbol immediately adjacent the character, there is disclosed the method of loading the codes in the memory for the display of a line of symbols by providing the keyboard with a key for each character that may be displayed as one of the symbols of the associated set wherein each of the keys represents a base symbol of the set, generating when one of the keys is depressed a base coded-combination of bits and modifying the base coded-combination of bits by changing at least one of the two least significant bits when any immediately adjacent key generated character is a space symbol.

2 Claims, 4 Drawing Figures

SYMBOL GENERATION SYSTEM - SGS

TELEVISION CHARACTER GENERATION SYSTEM - TCG

METHOD OF LINE BUFFER LOADING FOR A SYMBOL GENERATOR

BACKGROUND OF THE INVENTION

This invention pertains to symbol generators and, more particularly, to the loading of the line buffer memories of such generators. There are presently available symbol generators which are capable of generating lines of symbols or characters for use in television display systems.

When, for example, English text is to be displayed on a television screen one need only be concerned with whether the text is represented in upper or lower case, assuming that a particular font is being used. In such case, it makes no difference what the succeeding and preceding characters are with respect to a given character; however, in some languages such as Arabic, the situation is completely different. In Arabic, many characters have as many as four different forms. For example, a given character may have one form when it stands alone, i.e., it is neither preceded or followed by a space. It has another form if it is both preceded and followed by a space. It has a third form if it is preceded by a space and followed by non-space, and it has a fourth form if it is followed by a space and preceded by non-space symbol. Therefore, the font for the Arabic alphabet is quite large.

Conventional character generators used in television normally have a keyboard wherein each key is associated with a given character. Just as with a typewriter, there can be case shifting in a character generator to provide both upper and lower case characters. Thus, every form of the character is associated with one or possibly two keys, i.e., for instance, the letter "A" can be a capital "A" or a small "a". The two keys associated with these two variations are the basic key for the letter "A" and the case shift key. Thus, it is possible to minimize the size of the keyboard. With respect to the Arabic language, it has heretofore been necessary to provide separate keys for each one of the characters and for each one of its variations. Thus, in many cases it has been necessary to provide keyboards wherein there are four separate keys associated with a given character wherein each key generates one of the four possible variations of the character. Because of the size of the Arabic alphabet and all the associated variations, the size of the keyboard required to generate high quality characters for television display becomes excessively large. In addition, a burden is placed on the operator in that considerable dexterity and memory are required to operate such a keyboard.

BRIEF SUMMARY OF THE INVENTION

It is accordingly a general object of the invention to provide for the improved and simplified generation of characters which can be represented by a plurality of symbols.

It is another object of the invention to provide improved methods for loading the line memories of video symbol generators when the characters being handled can take on one of a plurality of symbol forms.

It is a still further object of the invention to provide improved methods for loading the line memory of a video symbol generator which is ideally suited for the Arabic language.

The invention contemplates a symbol-display system which includes a keyboard for entering indicia related to the symbols to be displayed and a memory for storing the indicia associated with a line of symbols to be displayed. The symbols are from a font which includes at least one character which is represented by a set of symbols wherein the actual symbol of the set to be used is determined by the absence or presence on the displayed line of a space symbol immediately adjacent (preceeding or following) to the character. In accordance with the invention, indicia are loaded into the memory by providing a keyboard with a key for each character that may be displayed as one of the symbols of the associated set. When a key is actuated, there is generated a coded combination of indicia representing the character or symbol associated with the key. There is also determined whether the immediately adjacent character is a space symbol. In response to such determination, there is stored in the memory a coded combination of indicia associated with the symbol of the set selected in accordance with whether or not the immediately adjacent symbol is or is not a space symbol.

BRIEF DESCRIPTION OF THE DRAWING

Other objects, features or advantages of the invention will become apparent from the following detailed description when read in conjunction with the accompanying drawings which show by way of example and not limitation apparatus for practicing the invention.

In the drawing.

DETAILED DESCRIPTION

Before describing the operation of apparatus for performing the invention some background material will be discussed.

The font of symbols is generally broken down to sets of symbols including a base symbol and up to three ancillary symbols. For example, a character can be represented by one of four symbols. The base symbol is that used when neither adjacent symbol is a space symbol (this base symbol can be the one actually shown on the keyboard). The three other symbols of the set concern the symbol used when a space symbol immediately preceeds and/or follows the symbol under consideration. In coding the symbols into bytes, the byte can be considered to have two parts (the same as a floating point number) i.e. a mantissa comprising the six most-significant bits of the byte and an exponent comprising the two most-significant bits of the byte. For example, for a given character can have the mantissa $x_1 x_2 x_3 x_4 x_5 x_6$ where $x_i=0$ or 1, and the exponent can be either 00, 01, 10, or 11. Arbitrarily, by way of example the base symbol of the set (that symbol surrounded by non-space symbols) is coded as $x_1 x_2 x_3 x_4 x_5 x_6 00$. This will be the byte code generated whenever the key representing the symbol set for the given character is depressed. Again by way of example, if the character under consideration were preceeded by a space symbol then the least significant bit of the byte would be a "1" otherwise it is a "0". Further, by way of example, if the character under consideration were followed by a space symbol then the second least-significant bit of the byte would be a "1" otherwise it is a "0".

Table I summarizes the rules for assigning coded combinations of exponent bits to a character having a mantissa portion $x_{10}\ x_{20}\ x_{30}\ x_{40}\ x_{50}\ x_6$ where $x_i=0$, or 1, where i=1, 2, . . ., 6

TABLE I

| Condition of Character Under Consideration | Byte Code |
|---|---|
| Surrounded by non-space symbols | $x_{10}\ x_{20}\ x_{30}\ x_{40}\ x_{50}\ x_{60}$ 00 |
| Preceeded by a space symbol | $x_1\ x_2\ x_3\ x_4\ x_5\ x_6$ 01 |
| Followed by a space symbol | $x_1\ x_2\ x_3\ x_4\ x_5\ x_6$ 10 |
| Surrouunded by space symbols | $x_1\ x_2\ x_3\ x_4\ x_5\ x_6$ 11 |

Furthermore, since each symbol must be displayed as keyed in, each symbol as being keyed-in results in its by code being loaded into the buffer. Thus, if the next symbol is a space symbol it will be necessary to effectively remove the preceeding byte from the buffer and replace it with the byte of the set representing that character followed by a space symbol.

With these considerations in mind a first embodiment of the invention will now be described.

Figure 1:
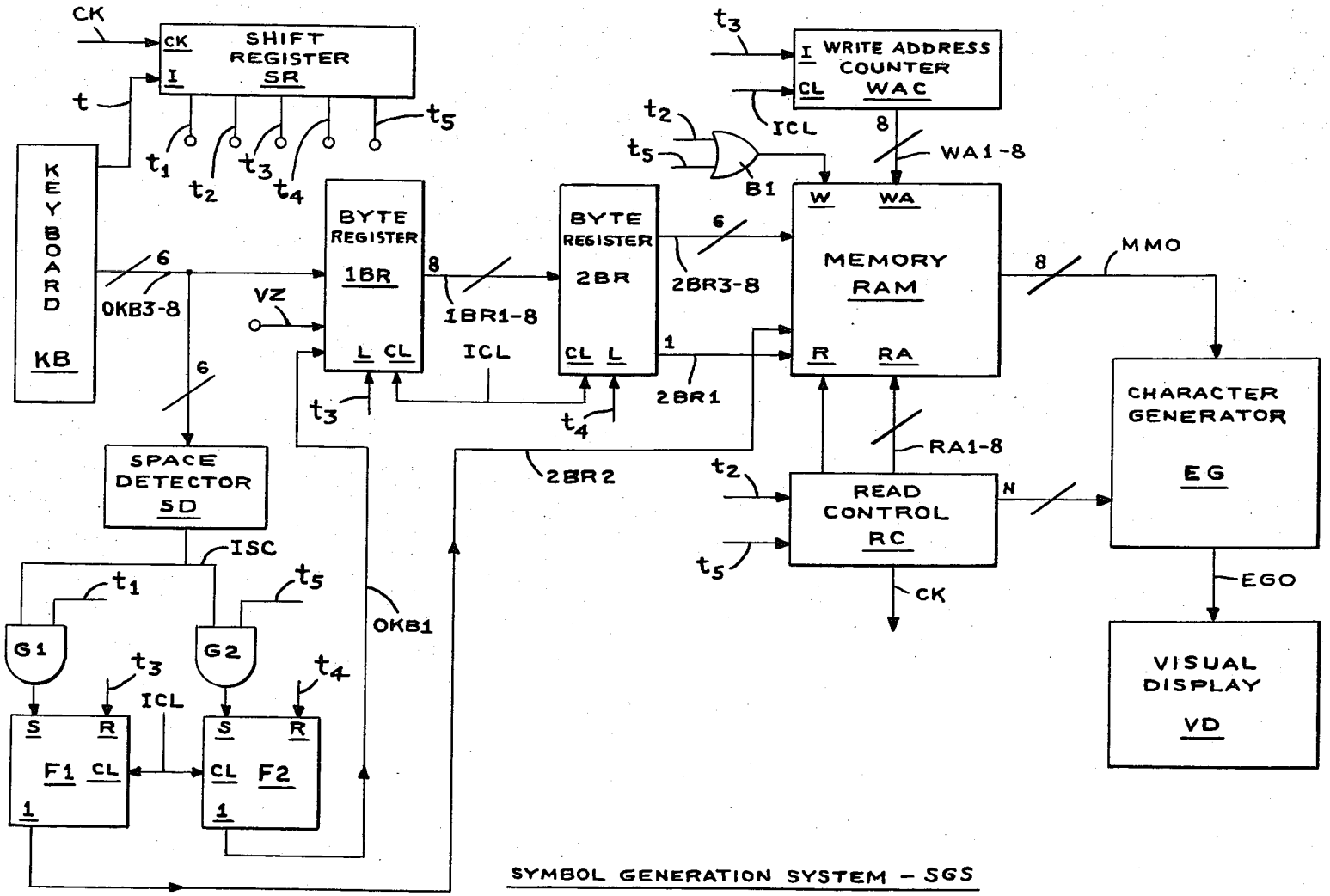
FIG. 1 is a block diagram of a character generator system which can be used to perform the method of the invention.

In FIG. 1 there is shown a symbol generation system which includes a keyboard KB which feeds a memory RAM via cascaded byte memories 1BR and 2BR. Tapped off the six-lead cable OKB3-8 is a space symbol detector SD which, in turn, feeds two space memory flipflops F1 and F2. Write control for the memory RAM is by the OR-circuit B1 and the address for writing is selected by the write address counter WAC. The read control RC controls the reading of the memory RAM and generates the clock for the system. The output of the memory RAM is fed to the character generator CG and from there to the visual display VD.

The keyboard KB can be of the type having a plurality of keys wherein as each key is depressed it generates at least, say, a 6 bit code (the mantissa) which is fed to the byte memory 1BR. At the same time as this code is fed to the byte memory 1BR a pulse is fed on the line t to the I-input of the shift register SR. The shift register SR thereafter generates a series of five sequential timing pulses on the lines T1 to T5, respectively. Shifting through the shift register is accomplished by pulses on the line CK from the clock in the read control RC. Thus, whenever a key is stroked a coded combination representing the mantissa portion of the byte code of the symbol for that key is fed onto cable OKB3-8. At the same time, this code is fed to space detector SD which can simply be a six-input AND-circuit which detects the coded combination of six bits representing the space symbol.

The byte register 1BR and the byte register 2BR are simply parallel arrays of eight bit-latches that initially cleared by signals on line ICL and are loaded by timing signals fed to their L-inputs.

The memory RAM can be a typical random access memory which upon receipt of a pulse at its write W-input will write the byte onto the eight-lines 2BR1 to 2BR8 into a byte cell having the address indicated by eight-line cable WA1-8 from which address counter WAC. In addition, upon receipt of a pulse on the read-input R, the memory will read onto byte eight-lead cable MMO the contents of the byte cell indicated by the address on the eight-line cable WA1-8.

The element generator EG upon receipt of bytes on the cable MMO and the cable N will generate dot codes or run length codes for passage via the line EGO to the visual display VD. Since the actual character generator EG, the visual display VD, and the read control RC do not form part of the present invention, they will not be discussed in detail.

The operation of the system will now be described.

At the start of operation a signal is generated on the line ICL to clear the flipflop F1 and F2 to the reset state, to clear the byte registers 1BR and 2BR to the point where they are storing merely eight zero bits each, and to clear the write address counter WAC to an address of zero.

It should be born in mind that whenever a key of the keyboard KB is depressed, there is emitted on the six lines of the cable OKB3-8 a six-bit coded combination of indicia. These six bits represent the six most-significant bits of a byte representing the mantissa portion of the byte of the character being depressed. At this point, the byte can be considered as six bits followed by two binary zeros. At the same time that this byte is being emitted by the keyboard KB, there is also emitted by the keyboard KB a pulse on the line t to the shift register SR. This pulse enters the first stage of the shift register SR and is then present on line t1. The pulse on the line t1 represents the first step in the loading cycle for the byte. At this time, the space detector SD indicates whether this character is or is not a space symbol. If it is a space symbol, the space detector SD will raise the line ISC. At this time, the pulse on the line t1 samples the AND-circuit G1 and if the space symbol is present, the flipflop F1 is set, raising the level of the line to 2BR2.

When a pulse is present on line t2, the read control RC is inhibited from reading any bytes to the element generator EG while, at the same time, a write pulse passes through the OR-circuit B1 to the write input W of the memory RAM and the byte on the lines 2BR1–2BR8 is written into the memory RAM. It should be noted that for the first character zeros are written into the address zero.

Thereafter, whatever the byte on the lines 2BR1 to 2BR8 will be written into the address shown by the write address counter WAC. In general, at this time t2, the byte on the lines 2BR1 to 2BR8 will over-write the previously stored byte. However, it should be noted that the byte on the lines 2BR1–2BR8 can be modified. In particular, the value of the second least-significant bit is controlled by the level of the line 2BR2 connected to the 1-output of the flipflop F1. Thus, if the flipflop F1 is set indicating that the symbol now being entered is a space symbol, the second least significant bit of the previously entered character is changed to a binary 1 and at the time t2 the byte on the lines 2BR1 to 2BR8 (the seven-bit partial byte i.e. the contents the byte register 2BR and the bit on line 2BR2 are again recorded in the byte register represented by the address from counter WAC which has as yet not been changed since the previous entry cycle. Thus, there can be an over-writing of the character. It is in this way that one is able to indicate that a character is being followed by a space symbol.

When there is a pulse on the line t3, the write address counter WAC is incrememted by one. Also at this time t3, the byte for the character KB is entered into the byte register 1BR2. The mantissa portion is fed in on the lines OKB3-8, the second least significant bit is forced to binary zero and the least significant bit is a function of the level of the line OKB1 whose output is controlled to flipflop F2. This flipflop will be set if the previous symbol was a space. If it were a space, then the least significant bit loaded into the byte register 1BR would be a binary 1. Finally, at time t3, the flipflop F1 is forced to the reset state.

At time t4, i.e., when a pulse is on the line t4, the following events happen: the flipflop F2 is forced to the reset state and the contents of the byte register 1BR2 present on the 8 lines of the cable 1BR1-8 are loaded into the byte register 2BR.

At time t5, i.e., when a pulse is on the line t5, the following events happen: AND-circuit G2 is sampled to determine whether a space symbol is being fed from the keyboard KB. If the space symbol is present, then the flipflop F2 is set. Otherwise, it remains in the reset state. At the same time, the contents of the byte register 2BR with the second least significant bit as a zero are loaded into the byte register of the memory RAM indicated by the address from the write counter WAC. The pulse on the line t5 also inhibits any read cycles by the read control RC.

This is a normal entry cycle for the system. Several things should be noted. In particular, for each symbol written into the memory, during the next cycle this symbol is overwritten such that it is possible to record the fact whether the following symbol is a space symbol. In addition, the byte loaded into the byte register 1BR is always forced to have a zero in the second least significant bit whereas the least significant bit is determined by the state of the flipflop F2 which stores the fact as to whether the previously written symbol was or was not a space symbol.

Figure 2:
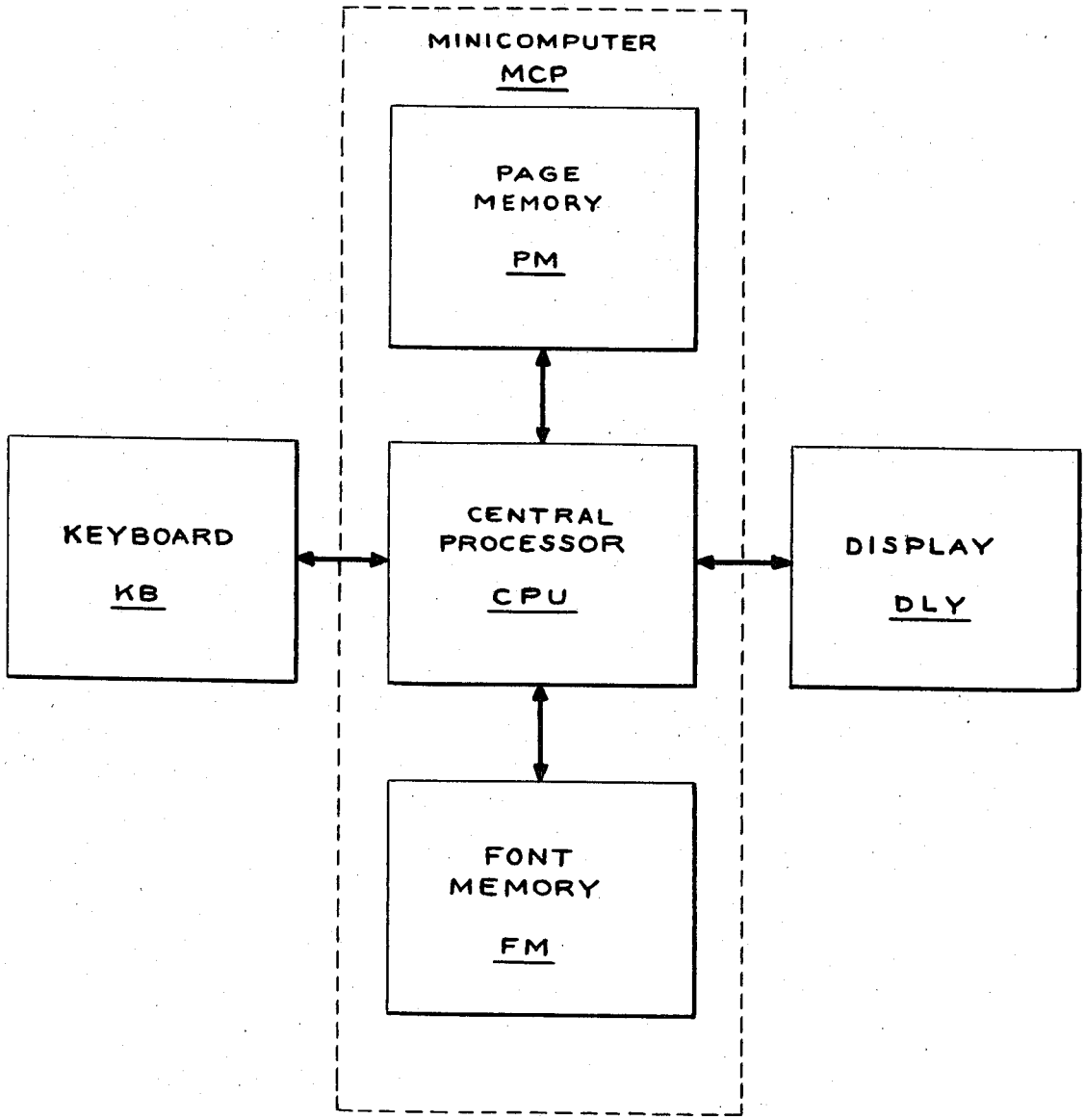
FIG. 2 is a block diagram of an alternate embodiment of the invention.

While the embodiment shown in FIG. 1 is quite suitable for use in an intelligent terminal having merely a line memory it is possible to expand and incorporate the invention within highly sophisticated character generators for use for example in television displays. In such case the keyboard would be connected to a microcomputer system and the character generation routine would be merely one function of the entire system. In such case instead of hard wire apparatus most of the processing would occur by use of the programs of the system. Accordingly, there is shown in FIG. 2 a television character generation TCG including a keyboard KB, a microcomputer MCP and a display VLY. While the microcomputer MCP is generally a self-contained system, it is shown as comprising the three parts concerned with the invention, that is, the central processing unit CPU, the page memory MP and the font memory FM. The font memory FM contains the actual on and off or dot codes utilized in the formation of the character. The page memory PM stores the character bytes for the characters which will be displayed by the display DL. The font memory would also store the character codes for selecting the on and off and/or dot codes (it should be noted that the page memory and font memory are both part of the memory of the minicomputer MCP). Although many minicomputers can be used in accordance with a preferred embodiment of the invention, there is used a DATAMATE 70.

Figure 3A:
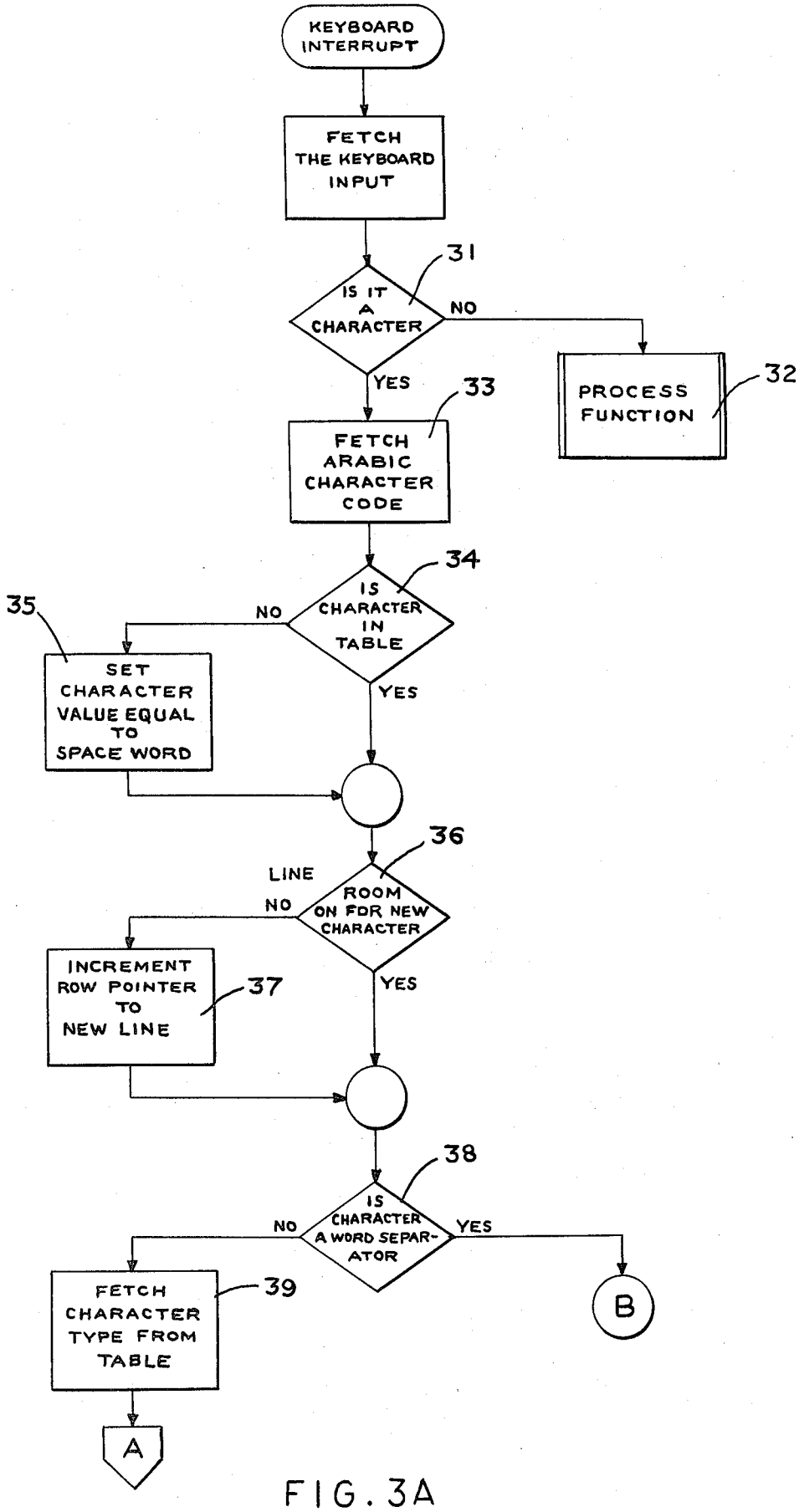
FIGS. 3A and 3B are flow charts describing the operation of the invention when performed with a minicomputer.
Figure 3B:
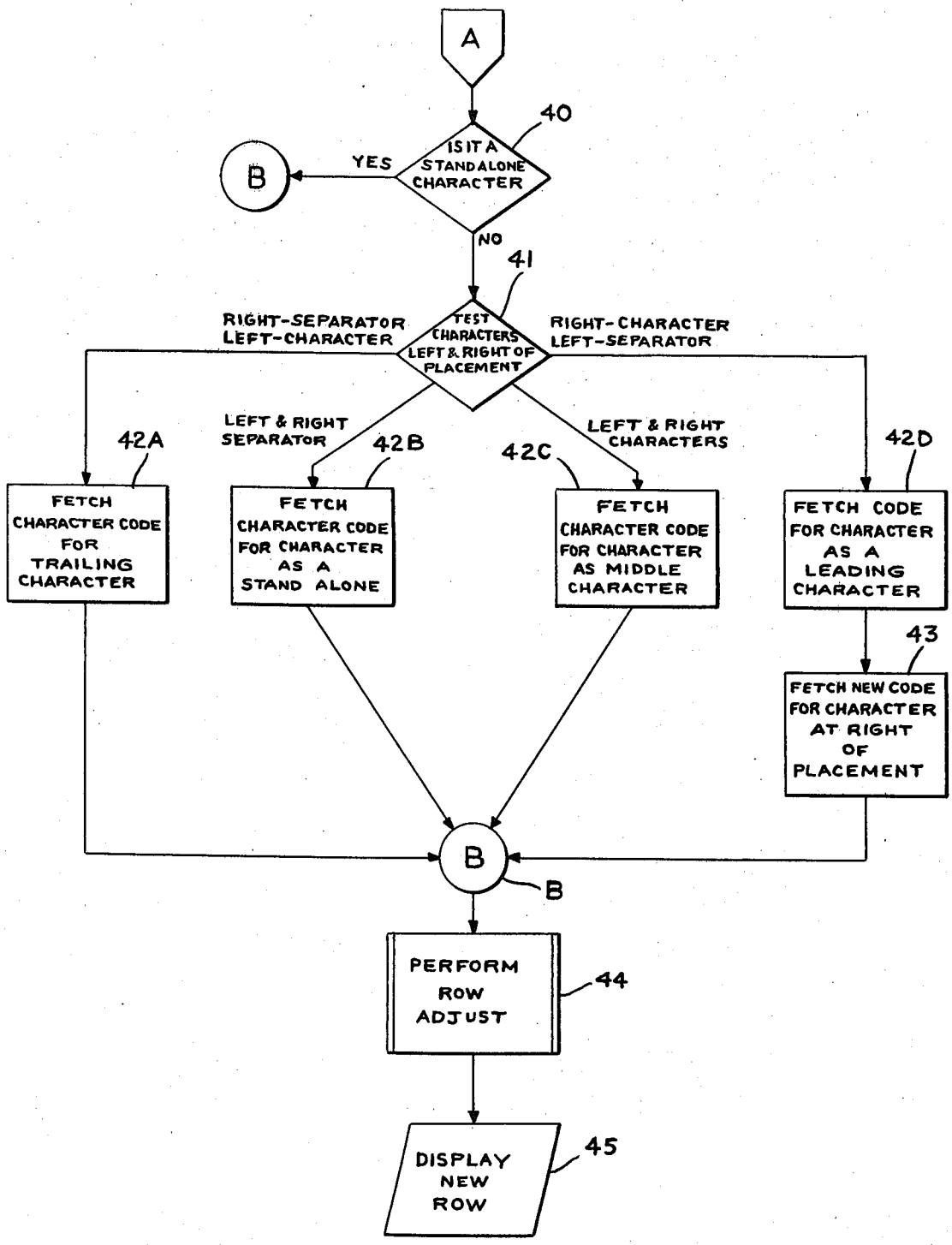

The microprocessor MCP is programmed in accordance with the flow chart shown in FIGS. 3*a* and 3*b*. In particular whenever a key of the keyboard is struck there is generated an eight-bit byte. This byte is fetched from the keyboard and a first test is made at 31. This test determines whether the byte is a character or a control byte. The control bytes, for instance, could be line feeds, backspacing, tabulations, etc. If it is a control byte the minicomputer performs a subroutine associated with the control byte. Since this does not form a part of the invention it will not be discussed. However if step 31 indicates that it is a character code, this character code is fed to the portion of the font memory FM and is used to select from say a function table the matching Arabic character code. This fetch function is performed in step 33. It should be noted that the Arabic character code would be like the codes of the first embodiment that is the character byte includes six variable most-significant bits and the two least-significant bits being zero. The results of the fetch routine can be either that the Arabic character code has been found in the function table or one has not been found. A test to determine this fact is done in step 34. If no Arabic character code is found then the byte is set to a space code. See step 35. In either event the next test is performed in step 36. This step determines whether the present line is able to accept another character. If the line is incapable of accepting another character, then a line counter is incremented by one to the next line. The incrementing is performed in step 37. If the line will accept the character, then the incrementing is not performed and the process goes to step 38. In step 38 a test is made to determine whether the byte indicates a character or a word separator. A word separator can be a space, can be a period, can be a comma, or similar type of punctuation marks. If it is a word separator it goes to point B in FIG. 3*b*. If it is not a word separator then in step 38 and step 39 a new test is performed. This test now says that yes we do have a character, now is it a character which only stands alone or is it a character which changes shape with respect to its neighbors. The results of this test are further processed in step 40. If it is a stand alone character the process again goes to point B. If it is not a stand alone character, then a test is made to determine what are the neighbors of the character. As in the embodiment of FIG. 1 the tests again result in four possibilities, that is, a character exists to the right of the character under consideration and a space exists to the left thereof. If this is the case, the character byte is modified by adding binary to the character code and step 42*a* is then performed. In 42*a* there is fetched the character code for a trailing character. If to the left and to the right of the character are under consideration are word separators then binary is added to the character byte and there is fetched from the font memory FM the character code for a stand alone character. A similar operation is performed in step 42*c* if the characters to the left and the right of the character code are characters. In step 42*d* the determination is made to determine if the character to the right is a character and the character to the left is a separator. Again the modification is made, however, this step requires that the previously recorded character must be changed according to this routine. This is similar to the case discussed in the embodiment of FIG. 1. In any event, after these tests the actual character code of the character to be displayed is now available. In step 44 there is performed a row adjust in that characters are filled in by means of left or right shifting if the character had been inserted by means of a changeable cursor. In step 45 there is displayed the characters. Since the display forms no part of the invention, it need not be described. It should be realized that there exist many display generators which, given the character codes and the on and off or dot code memories, work in synchronism with the raster signals of a CRP display to generate the characters.

While only a limited number of embodiments of the invention have been shown and described in detail there will now be obvious to those skilled in the art many modifications and variations satisfying many or all of the objects of the invention while not departing from the spirit thereof as defined in the appended claims.

What is claimed is:

1. In a symbol-display system which includes a keyboard for entering indicia related to the symbols to be displayed and a memory for storing the indicia associated with a line of symbols to be displayed, the symbols being from a font which includes at least one character represented by a set of symbols wherein the actual symbol to be used of the set is determined by the presence or absence on the displayed line of a space symbol immediately adjacent the character, the method of loading said indicia in the memory for the display of at least a line of symbols comprising the steps of providing the keyboard with at least a key for each character that may be displayed as one of the symbols of the associated set, each of said keys representing a base symbol of the set, generating when one of said keys is depressed a base coded-combination of bits, modifying said base coded-combination of bits by changing at least one of the bits in two specific bit positions of said base coded-combination of bits when any immediately adjacent key generated character is a space symbol.

2. The method of claim 1 wherein said base coded combination of bits are zero bits and said modifying is accomplished by adding binary 1 and or 2 to said base combination of bits.

* * * * *